US007834714B2

(12) United States Patent
Weiss et al.

(10) Patent No.: US 7,834,714 B2
(45) Date of Patent: Nov. 16, 2010

(54) HF TERMINATING RESISTOR HAVING A PLANAR LAYER STRUCTURE

(75) Inventors: Frank Weiss, Bernsdorf (DE); Dietrich Zahn, Dresden (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/064,764

(22) PCT Filed: Aug. 16, 2006

(86) PCT No.: PCT/EP2006/008089

§ 371 (c)(1),
(2), (4) Date: Jun. 11, 2008

(87) PCT Pub. No.: WO2007/022906

PCT Pub. Date: Mar. 1, 2007

(65) Prior Publication Data

US 2009/0134959 A1 May 28, 2009

(30) Foreign Application Priority Data

Aug. 26, 2005 (DE) ..... 20 2005 013 515

(51) Int. Cl.
*H01P 1/26* (2006.01)

(52) U.S. Cl. ..... 333/22 R

(58) Field of Classification Search ..... 333/22 R, 333/81 A

See application file for complete search history.

(56) References Cited

U.S. PATENT DOCUMENTS 4,310,812 A * 1/1982 DeBloois ..... 333/81 A
4,965,538 A * 10/1990 Mickey, III ..... 333/81 A

FOREIGN PATENT DOCUMENTS

| | | |
|---|---|---|
| DE | 2133647 | 7/1970 |
| EP | 0424536 A1 | 5/1991 |
| EP | 1460710 A1 | 9/2004 |

* cited by examiner

*Primary Examiner*—Stephen E Jones
(74) *Attorney, Agent, or Firm*—Robert Curcio; DeLio & Peterson, LLC

(57) ABSTRACT

The invention relates to an HF terminating resistor having a planar layer structure which, on a substrate (16), comprises a resistor layer (10) for converting HF energy to heat, an input conductor (12) for supplying HF energy and an earthing conductor (14) for the electric connection to an earthing contact (22). The input conductor (12) is electrically connected to a first end (18) of the resistor layer (10) and the earthing conductor (14) is electrically connected to a second end (20) of the resistor layer (10) opposite the first end (18). On an earthing contact end of the layer structure, the earthing conductor (14) forms the topmost layer of the layer structure. The invention is characterized in that the earthing conductor (14) is at least partially arranged on the resistor layer (10).

9 Claims, 2 Drawing Sheets

HF TERMINATING RESISTOR HAVING A PLANAR LAYER STRUCTURE

The present invention relates to an HF terminating resistor having a planar layer structure which, on a substrate, comprises a resistor layer for converting HF energy to heat, an input conductor for supplying HF energy and an earthing conductor for the electric connection to an earthing contact, in which the input conductor is electrically connected to a first end of the resistor layer and the earthing conductor is electrically connected to a second end of the resistor layer opposite the first end, and on an earthing contact end of the layer structure, the earthing conductor forms the topmost layer of the layer structure, according to the introductory clause of claim 1. The invention further relates to a method for producing a planar layer structure for an HF terminating resistor, in which on a substrate a resistor layer is formed for converting HF energy to heat, an input conductor for supplying HF energy and an earthing conductor for the electric connection to an earthing contact, in which the input conductor is electrically connected to a first end of the resistor layer and the earthing conductor is electrically connected to a second end of the resistor layer opposite the first end, according to the introductory clause of claim 6.

HF terminating resistors are used for example for matching HF assemblies in the mobile and radio link field with very high transmitting power, e.g. to terminate a combiner or antenna output. Terminating resistors of increased power loss have large resistance structures in order to distribute the coupled-in HF power to this area. However, this has an unfavourable effect on the reflection factor in broadband application, or the terminating resistor is only able to be used in a narrower frequency band with the same reflection factors.

In the above-mentioned HF terminating resistors, special constructions of the substrate structures are necessary in order, through these, to meet the very high technical requirements.

The invention is based on the problem of developing an HF terminating resistor of the above-mentioned type and a method of the above-mentioned type in such a way that the earthing connection of the resistor structure of the substrate to the earthing contact, such as for example a housing wall, is on the one hand very short, in order to obtain as precise a matching as possible of the wave resistance, but on the other hand is constructed so that a good solder joint can still form for the earthing contact between the earthing conductor and the earthing contact.

This problem is solved according to the invention by an HF terminating resistor of the above-mentioned type with the features characterized in claim 1 and by a method of the above-mentioned type with the features characterized in claim 6. Advantageous developments of the invention are described in the further claims.

In an HF terminating resistor of the above-mentioned type, provision is made according to the invention that the earthing conductor is at least partially arranged on the resistor layer.

In a method of the above-mentioned type, provision is made according to the invention that firstly the resistor layer is formed on the substrate and thereafter the earthing conductor is formed at least partially on the resistor layer.

This has the advantage that the upper side of the earthing conductor lies completely free and is thereby fully available for the contacting with the earthing contact. Hereby, it is possible to form the earthing conductor to be as short as necessary for a sufficient electrical connection with the earthing contact, so that the negative electrical effects of the earthing connection on the matching of the wave resistance of the HF terminating resistor can be minimized and at the same time the surface which is available for the electrical contacting can be maximized.

In a preferred embodiment, the earthing conductor is arranged on the substrate on an earthing contact end of the layer structure, and has a widened portion extending towards the first end of the resistor layer, this widened portion being arranged on the resistor layer.

A good electrical contacting, able to be produced in a functionally reliable way, between the earthing conductor and the earthing contact is achieved in that an upper side of the earthing conductor facing away from the substrate extends in an area both in the region of the end of the layer structure on the earthing contact side in which the earthing conductor lies on the substrate, and also in the region of the widened portion in which the earthing conductor lies on the resistor layer.

To carry off the heat generated in the resistor layer, the planar layer structure is arranged in a housing of electrically conductive material, with the earthing contact being the housing.

Expediently, the earthing contact is arranged on an end face of the planar layer structure on the earthing contact side.

The invention is explained in further detail below with the aid of the drawings, in which.

Figure 1:
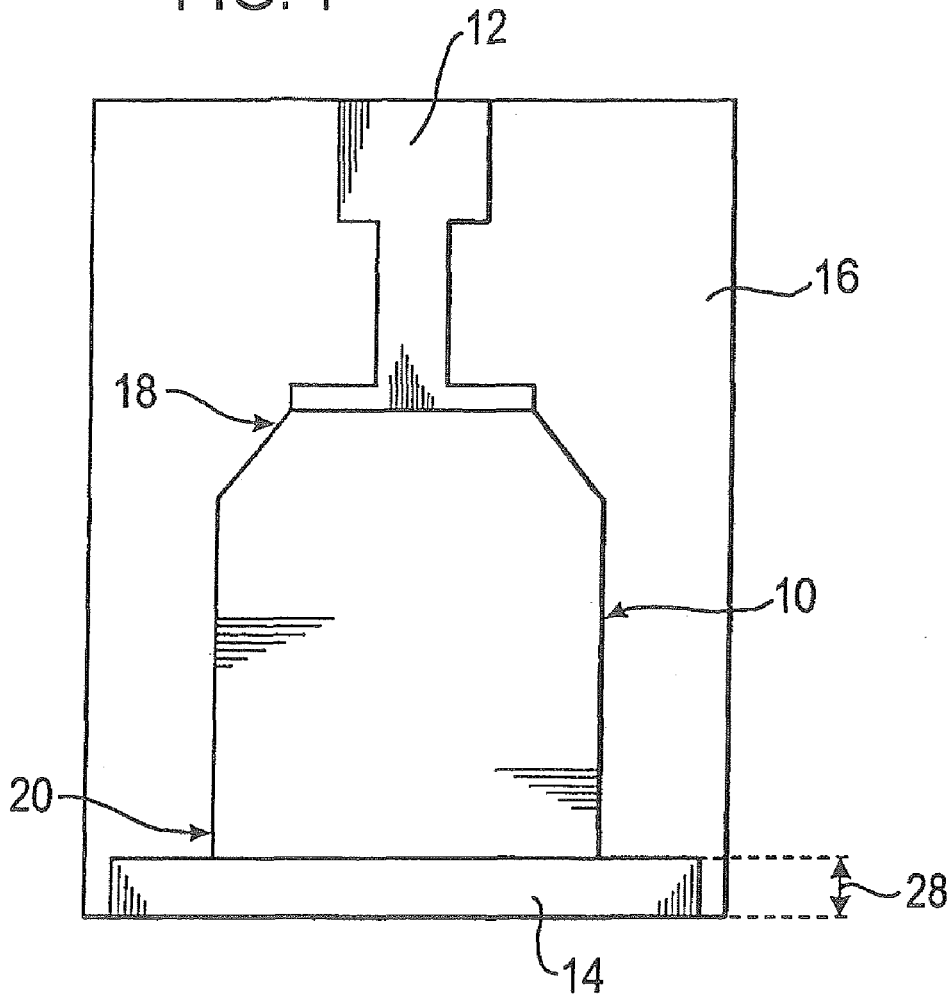
FIG. 1 shows a preferred embodiment of an HF terminating resistor according to the invention, in top view.

The preferred embodiment, which can be seen from FIG. 1, of an HF terminating resistor according to the invention comprises a resistor layer 10, an input conductor 12 and an earthing conductor 14. The resistor layer 10, the input conductor 12 and the earthing conductor 14 are formed as respective layers on a substrate 16 and form a planar layer structure. The input conductor 12 is electrically connected to a first end 18 of the resistor layer 10, and the earthing conductor 14 is electrically connected with a second end 20 of the resistor layer 10 opposite the first end 18. The resistor layer 10 serves to convert HF energy to heat, the input conductor 12 serves to supply HG energy, and the earthing conductor 14 serves for electrical connection to an earthing contact 22 (FIG. 2).

Figure 2:
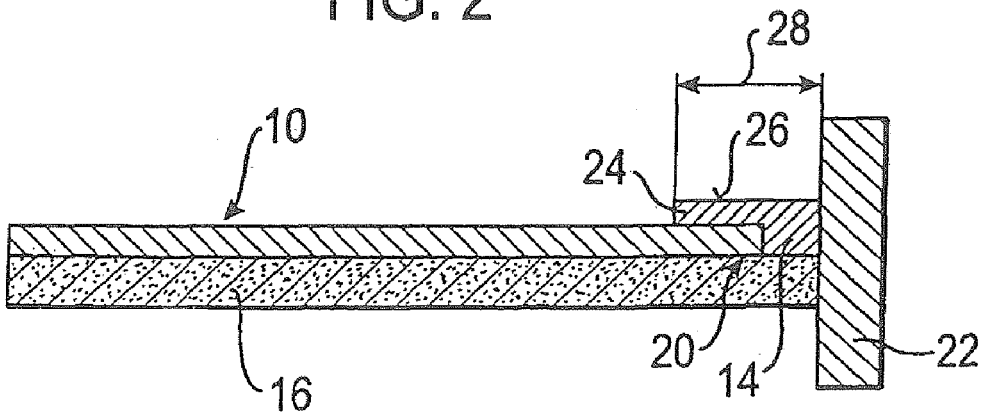
FIG. 2 shows the HF terminating resistor of FIG. 1 in diagrammatic sectional view.

The planar layer structure, formed by the input conductor 12 (not illustrated in FIG. 2), the resistor layer 10 and the earthing conductor 14 can be seen in further detail from FIG. 2. The earthing contact 22 is arranged on the end face on an end of the layer structure on the earthing contact side, and is a part of a housing, for example. This housing is made from an electrically conductive material and thereby also has good heat-conducting properties, so that the thermal energy occurring in the resistor layer 10 is carried off to a cooling body via the housing.

The earthing conductor 14 produces the electrical contact between the resistor layer 10 and the housing 22. According to the invention, the earthing conductor 14 is arranged at least partially on the resistor layer 10. At the end of the layer structure on the earthing contact side, the earthing conductor 14 is arranged on the substrate 16. A widened portion 24 of the earthing conductor 14 which is arranged on the resistor layer 10 extends in the direction of the first end 18 of the resistor layer 10, i.e. the resistor layer 10 is arranged in the region of the widened portion 24 between the substrate 16 and the earthing conductor 14.

An upper side 26 of the earthing conductor 14, facing away from the substrate 16, extends in an area both in the region of the end of the layer structure on the earthing contact side, in which the earthing conductor 14 lies on the substrate 16, and also in the region of the widened portion 24, in which the earthing conductor 14 lies on the resistor layer 10. This flat upper side 26 of the earthing conductor 14 serves to provide the electrical contact with the housing 22, in which preferably a soldered joint is produced. To do this, a length 28 of the earthing conductor 14, i.e. an extent of the earthing conductor 14 in the propagation direction of the HF wave, must have a minimum length because otherwise a sufficient solder fillet cannot form. On the other hand, negative effects occur all the greater on the impedance matching, the greater the value for the length 28. Through the fact that the earthing conductor 14 at the end of the layer structure on the earthing contact side also constitutes the topmost layer in the region of the overlap with the resistor layer 10, this length 28 can be selected to be as small as is absolutely necessary for contacting with the housing. The negative influence of the earthing conductor 14 on the impedance matching of the HF terminating resistor is thereby minimized.

A short geometric distance is necessary between the second end 20 of the resistor layer 10 and the housing wall 22. At the same time, the technological requirement exists for a sufficient length 28 of the soldered joint and for a favorably priced construction. All requirements are met by the layer structure according to the invention (earthing conductor 14 on resistor layer 10). A simple, favorably priced construction is produced (no front face contacting), a sufficient soldering surface for a uniform, clean soldered joint (earthing connection to the housing 22, which ensures a fillet formation), and despite large resistance structures one has a contact point for optimizing the reflection factor, because the length 28 of the earthing conductor 14 has a crucial influence on the electrical parameters. The illustrated favorably priced manufacturing technology for planar structures has a very advantageous effect on the HF properties.

A method for producing a planar layer structure for an HF terminating resistor, in which a resistor layer for converting HF energy to heat, an input conductor for supplying HF energy and an earthing conductor for electrical connection to an earthing contact is formed on a substrate, in which the input conductor is electrically connected to a first end of the resistor layer and the earthing conductor is electrically connected to a second end of the resistor layer opposite the first end, is characterized in that firstly the resistor layer is formed on the substrate and thereafter the earthing conductor is formed at least partially on the resistor layer.

Figure 3:
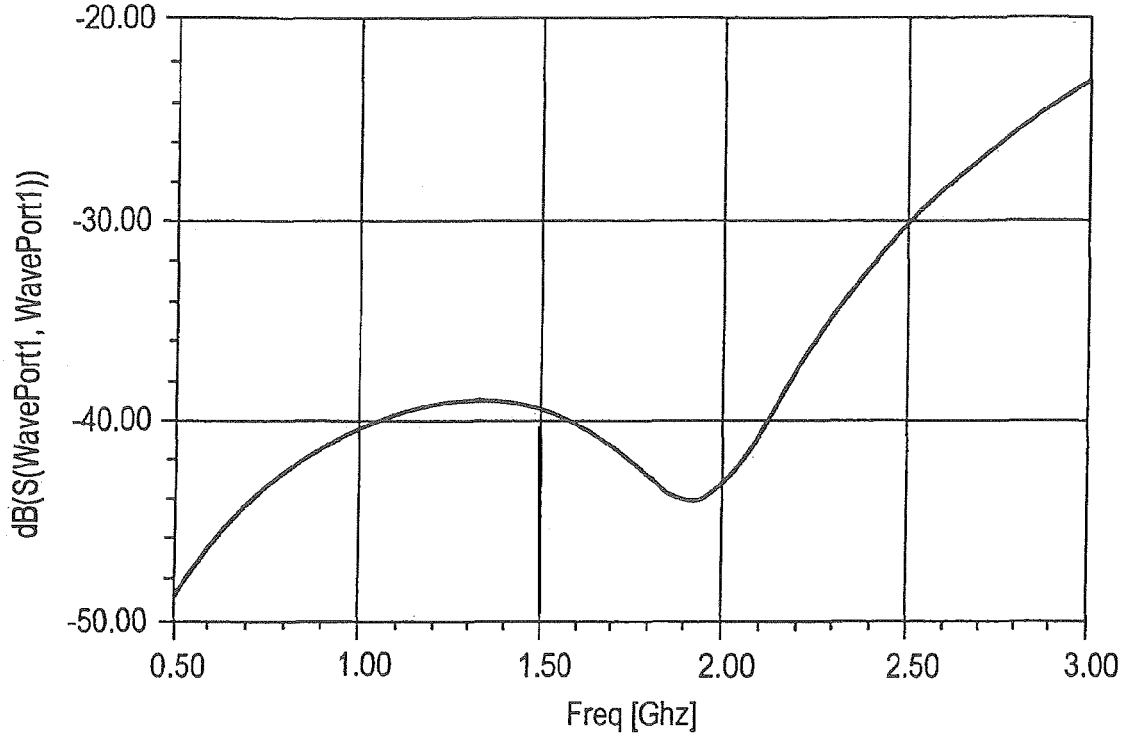
FIG. 3 shows a graphical illustration of the matching of the wave resistance over the frequency for a length of the earthing conductor of L=0.6 mm.
Figure 4:
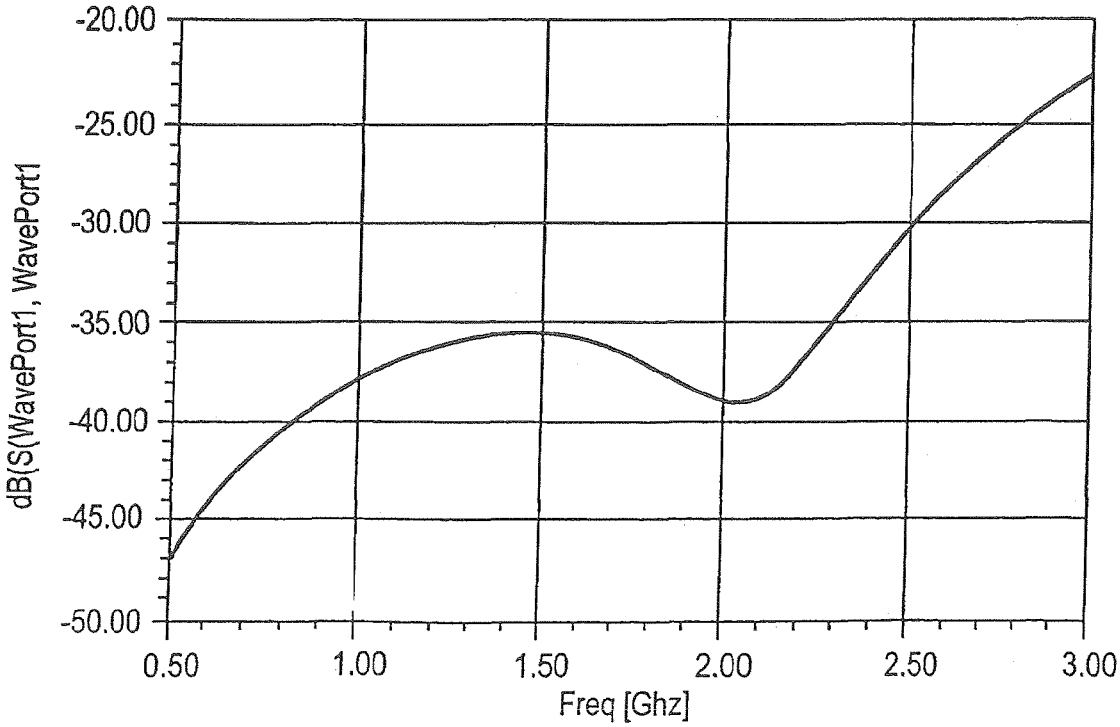
FIG. 4 shows a graphical illustration of the matching of the wave resistance over the frequency for a length of the earthing conductor of L=1.1 mm.

The influence of the length L 28 of the earthing conductor 14 is shown in FIGS. 3 and 4. In FIG. 3 the impedance matching is indicated over the frequency for L=0.6 mm and in FIG. 4 the impedance matching is indicated over the frequency for L=1.1 mm. As can be immediately seen, in the range of 0.50 GHz to 2.00 GHz an impedance matching which is better by approximately 4 dB is produced for length 28 L=0.6 (FIG. 3).

The invention claimed is:

1. An HF terminating resistor having a planar layer structure which, on a substrate, comprises a resistor layer for converting HF energy to heat, an input conductor for supplying HF energy and an earthing conductor for the electric connection to an earthing contact where the earthing contact is arranged on an end face of the planar layer structure on the earthing contact side, in which the input conductor is electrically connected to a first end of the resistor layer and the earthing conductor is electrically connected to a second end of the resistor layer opposite the first end, and on an earthing contact end of the layer structure, the earthing conductor forms the topmost layer of the layer structure, characterized in that the earthing conductor is at least partially arranged on the resistor layer extending parallel to and beyond said resistor layer second end.

2. The HF terminating resistor according to claim 1, including having the planar layer structure arranged in a housing of electrically conductive material, with the earthing contact being the housing.

3. The HF terminating resistor according to claim 1, wherein said earthing conductor extends beyond both sides of said resistor layer in a direction perpendicular to said resistor layer first end.

4. The HF terminating resistor according to claim 1, including at the end of the layer structure on the earthing contact side, the earthing conductor is arranged on the substrate and has a widened portion extending in the direction of the first end of the resistor layer, which portion is arranged on the resistor layer.

5. The HF terminating resistor according to claim 4, including having the planar layer structure arranged in a housing of electrically conductive material, with the earthing contact being the housing.

6. The HF terminating resistor according to claim 4, including having the earthing contact arranged on an end face of the planar layer structure on the earthing contact side.

7. The HF terminating resistor according to claim 4, including having an upper side of the earthing conductor facing away from the substrate extending in an area both in the region of the end of the layer structure on the earthing contact side, in which the earthing conductor lies on the substrate and also in the region of the widened portion, in which the earthing conductor lies on the resistor layer.

8. The HF terminating resistor according to claim 7, including having the planar layer structure arranged in a housing of electrically conductive material, with the earthing contact being the housing.

9. A method for the production of a planar layer structure for an HF terminating resistor comprising a resistor layer for converting HF energy to heat, an input conductor for supplying HF energy and an earthing conductor for the electric connection to an earthing contact is formed on a substrate, in which the input conductor is electrically connected to a first end of the resistor layer and the earthing conductor is electrically connected to a second end of the resistor layer opposite the first end, including having the resistor layer firstly formed on the substrate and thereafter the earthing conductor formed at least partially on the resistor layer and extending parallel to and beyond said resistor layer second end.

* * * * *